US011430601B2

(12) United States Patent
Otsubo et al.

(10) Patent No.: US 11,430,601 B2
(45) Date of Patent: Aug. 30, 2022

(54) COIL COMPONENT

(71) Applicant: Murata Manufacturing Co., Ltd., Kyoto (JP)

(72) Inventors: Yoshihito Otsubo, Kyoto (JP); Norio Sakai, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 1273 days.

(21) Appl. No.: 15/635,623

(22) Filed: Jun. 28, 2017

(65) Prior Publication Data

US 2017/0301456 A1 Oct. 19, 2017

Related U.S. Application Data

(63) Continuation of application No. PCT/JP2016/050101, filed on Jan. 5, 2016.

(30) Foreign Application Priority Data

Jan. 7, 2015 (JP) ..... JP2015-001468

(51) Int. Cl.
*H01F 27/08* (2006.01)
*H01F 27/28* (2006.01)
(Continued)

(52) U.S. Cl.
CPC ..... *H01F 27/2876* (2013.01); *H01F 17/0013* (2013.01); *H01F 17/0033* (2013.01);
(Continued)

(58) Field of Classification Search
CPC .. H01F 27/2876; H01F 17/062; H01F 27/292; H01F 27/22; H01F 17/0033;
(Continued)

(56) References Cited

U.S. PATENT DOCUMENTS 2,765,448 A * 10/1956 Duffing ..... H01F 38/023 336/221
2,907,968 A * 10/1959 Thurk ..... H01F 30/16 336/221

(Continued)

FOREIGN PATENT DOCUMENTS

| | | | |
|---|---|---|---|
| JP | H04-046570 | U | 4/1992 |
| JP | H05-267062 | A | 10/1993 |
| JP | 2010-516056 | A | 5/2010 |
| JP | 2014-038884 | A | 2/2014 |

OTHER PUBLICATIONS

International Search Report for PCT/JP2016/050101 dated Mar. 22, 2016.
Written Opinion of International Searching Authority for PCT/JP2016/050101 dated Mar. 22, 2016.

*Primary Examiner* — Mang Tin Bik Lian
(74) *Attorney, Agent, or Firm* — Pearne & Gordon LLP

(57) ABSTRACT

A coil electrode 4 provided in a coil component 1*a* includes a plurality of inner metal pins 5*a* arranged on an inner peripheral side of a coil core 3, a plurality of outer metal pins 5*b* arranged on an outer peripheral side of the coil core 3 to form a plurality of pairs with the inner metal pins 5*a*, a plurality of lower wiring patterns 7 that connect lower ends of the inner metal pins 5*a* and the outer metal pins 5*b* in the pairs, and a plurality of upper wiring patterns 6 that connect upper ends of the outer metal pins 5*b* to upper ends of inner metal pins 5*a* adjacent to the inner metal pins 5*a* that form the pairs with the outer metal pins 5*b*.

16 Claims, 8 Drawing Sheets

(51) Int. Cl.

| | |
|---|---|
| ***H01F 17/06*** | (2006.01) |
| ***H01F 27/29*** | (2006.01) |
| ***H01F 27/22*** | (2006.01) |
| ***H01F 17/00*** | (2006.01) |
| ***H01F 27/24*** | (2006.01) |
| ***H01F 41/04*** | (2006.01) |

(52) U.S. Cl.
CPC ..... *H01F 17/062* (2013.01); *H01F 27/22* (2013.01); *H01F 27/24* (2013.01); *H01F 27/2804* (2013.01); *H01F 27/292* (2013.01); *H01F 41/043* (2013.01); *H01F 2027/2809* (2013.01)

(58) Field of Classification Search
CPC .. H01F 17/0013; H01F 27/24; H01F 27/2804; H01F 41/043; H01F 2027/2809
See application file for complete search history.

(56) References Cited

U.S. PATENT DOCUMENTS

| | | | | |
|---|---|---|---|---|
| 5,191,699 | A | 3/1993 | Ganslmeier et al. | |
| 5,978,231 | A * | 11/1999 | Tohya | H05K 1/0233 361/782 |
| 8,466,769 | B2 * | 6/2013 | Dalmia | H01F 17/0006 336/200 |
| 2002/0046668 | A1 | 4/2002 | Bell | |
| 2002/0047768 | A1 | 4/2002 | Duffy | |
| 2009/0002111 | A1 | 1/2009 | Harrison et al. | |
| 2014/0043131 | A1 * | 2/2014 | Dalmia | H01F 5/003 336/200 |
| 2014/0132386 | A1 * | 5/2014 | Kostelnik | H01F 5/00 336/200 |
| 2015/0348695 | A1 * | 12/2015 | Kostelnik | H01F 17/0006 336/200 |

* cited by examiner

COIL COMPONENT

This application is a continuation of International Application No. PCT/JP2016/050101 filed on Jan. 5, 2016 which claims priority from Japanese Patent Application No. 2015-001468 filed on Jan. 7, 2015. The contents of these applications are incorporated herein by reference in their entireties.

BACKGROUND OF THE DISCLOSURE

Field of the Disclosure

The present disclosure relates to a coil component including an insulating layer having a coil core embedded therein and a coil electrode wound around the coil core.

Description of the Related Art

In an electronic device using a high-frequency signal, a coil component is sometimes used to prevent noise. Such a type of coil component is composed of a coil core made of, for example, a magnetic material and a coil electrode wound around the coil core. Here, the coil electrode is often wound by manual operation. Eliminating this manual operation is a problem in terms of the reduction of the manufacturing cost of the coil component.

Accordingly, there has hitherto been proposed a coil component that does not require any manual operation. For example, a coil component 100 described in Patent Document 1 illustrated in FIG. 9 includes an insulating layer 101 having an annular coil core 102 provided therein and two coil electrodes 103 and 104 wound around the coil core 102. Each of the coil electrodes 103 and 104 includes a plurality of upper wiring patterns 105*a* arranged on an upper surface of the insulating layer 101, a plurality of lower wiring patterns 105*b* arranged on a lower surface of the insulating layer 101, a plurality of inner columnar conductors 106*a* each of which connects one end of a predetermined upper wiring pattern 105*a* and one end of a predetermined lower wiring pattern 105*b* in an inner side portion of the coil core 102, and a plurality of outer columnar conductors 106*b* each of which connects the other end of a predetermined upper wiring pattern 105*a* and the other end of a predetermined lower wiring pattern 105*b* in an outer side portion of the coil core 102.

For example, the upper and lower wiring patterns 105*a* and 105*b* are formed by screen printing using conductive paste, and the inner and outer columnar conductors 106*a* and 106*b* are constituted by metal pins or via conductors. Such a structure of the coil electrodes 103 and 104 eliminates the necessity of an operation of manually winding the coil electrodes 103 and 104. Hence, a low-cost coil component 100 can be produced.

Patent Document 1: Japanese Unexamined Patent Application Publication No. 2014-38884 (see, for example, paragraphs 0031 to 0039 and FIG. 1)

BRIEF SUMMARY OF THE DISCLOSURE

In this type of coil component 100, a high current is sometimes passed through the coil electrodes 103 and 104. In such a case, the amount of heat generated from the coil electrodes 103 and 104 becomes large during the passage of the current. When the temperatures of the coil electrodes 103 and 104 rise, the temperature rise may deteriorate the characteristics and may affect the characteristics of other components mounted together with the coil component 100. Hence, there is a request for a coil component having good heat radiation characteristics.

The present disclosure has been made in view of the above-described problems, and an object of the disclosure is to improve the heat radiation characteristics in a coil component including an insulating layer having a coil core embedded therein and a coil electrode wound around the coil core.

To achieve the above-described object, a coil component according to the present disclosure includes an insulating layer having an annular coil core embedded therein and a coil electrode wound around the coil core. The coil electrode includes a plurality of inner conductors arranged along an inner peripheral surface of the coil core while being exposed at one end from one principal surface of the insulating layer and being exposed at the other end from the other principal surface of the insulating layer, a plurality of outer conductors arranged along an outer peripheral surface of the coil core to form a plurality of pairs with the inner conductors while being exposed at one end from the one principal surface of the insulating layer and being exposed at the other end from the other principal surface of the insulating layer, a plurality of first wiring patterns provided on the one principal surface of the insulating layer to connect the one end of each of the inner conductors to the one end of the outer conductor that forms the pair with the inner conductor, and a plurality of second wiring patterns provided on the other principal surface of the insulating layer to connect the other end of each of the outer conductors to the other end of the inner conductor adjacent to the inner conductor that forms the pair with the outer conductor. Each of the first wiring patterns has a first wiring portion that connects the one end of the outer conductor and the one end of the inner conductor, and at least one of the first wiring patterns further has a first heat radiating portion extended from the first wiring portion toward at least one of an inner peripheral side and an outer peripheral side of the coil core.

According to this structure, at least one of the first wiring patterns has the first heat radiating portion extended from the first wiring portion. Therefore, the first wiring pattern has a heat radiating function using the first heat radiating portion in addition to a function of connecting one end of a predetermined inner conductor and one end of a predetermined outer conductor. This can improve the heat radiation characteristics of the coil component. Also, since the heat radiation characteristics of the coil component are improved, it is possible to cope with the passage of a high current through the coil electrode.

The first wiring pattern having the first heat radiating portion may be provided so that a first distance serving as a distance from the inner conductor or the outer conductor located on the one of the inner peripheral side and the outer peripheral side of the coil core to an end portion of the first wiring pattern on a side of the first heat radiating portion is longer than a second distance serving as a distance from the inner conductor or the outer conductor to the coil core in plan view. Since this can increase the size of the first heat radiating portion, the heat radiation characteristics of the coil component can be improved.

The first distance is preferably twice or more than the second distance. In this case, the heat radiation characteristics of the coil component can be improved reliably.

The first heat radiating portion may be extended from the first wiring portion toward the outer peripheral side of the coil core. When the coil core is annular, the degree of flexibility in designing, for example, the wiring patterns is higher on the outer peripheral side of the coil core than on the inner peripheral side. Accordingly, the region where the first heat radiating portion is formed can be easily widened by extending the first heat radiating portion toward the outer peripheral side of the coil core.

The first heat radiating portion may be extended to follow a contour of the one principal surface. In this case, the first heat radiating portion can be formed to follow the contour shape of the one principal surface of the insulating layer. Hence, the area of the first heat radiating portion in a plan view can be increased easily.

The first heat radiating portion may be provided to reach an edge of the one principal surface of the insulating layer. In this case, since the region where the first heat radiating portion is formed can be widened, the heat radiation characteristics of the coil component can be improved further. Also, since the first heat radiating portion is exposed from a side surface of the insulating layer, the heat radiation characteristics of the coil component can be improved further.

The one principal surface of the insulating layer may have a rectangular shape, and the first heat radiating portion may be provided only in some of the first wiring patterns disposed near four corner portions of the one principal surface of the insulating layer. When the one principal surface of the insulating layer is rectangular, since the degree of freedom of designing, for example, the wiring patterns, is high in the four corner portions, the first heat radiating portion can be easily made large. For this reason, when the first heat radiating portion is provided in only some of the first wiring patterns disposed near the four corner portions, the heat radiation characteristics can be improved efficiently.

The first heat radiating portion may be provided in all of the first wiring patterns. In this case, the heat radiation characteristics of the coil component can be improved further.

Each of the second wiring patterns may have a second wiring portion that connects the other end of the outer conductor and the other end of the inner conductor, and at least one of the second wiring patterns may further have a second heat radiating portion extended from the second wiring portion to at least one of the inner peripheral side and the outer peripheral side of the coil core. In this case, the second wiring pattern can also have a heat radiating function, and therefore, the heat radiation characteristics of the coil component can be improved further.

According to the present disclosure, at least one of the first wiring patterns has the first heat radiating portion extended from the first wiring portion. The first wiring pattern has the heat radiating function using the first heat radiating portion in addition to the function of connecting one end of a predetermined inner conductor and one end of a predetermined outer conductor. Hence, the heat radiation characteristics of the coil component can be improved. Further, since the heat radiation characteristics of the coil component are improved, it is possible to cope with the passage of a high current through the coil electrode.

DETAILED DESCRIPTION OF THE DISCLOSURE

First Embodiment

Figure 1:
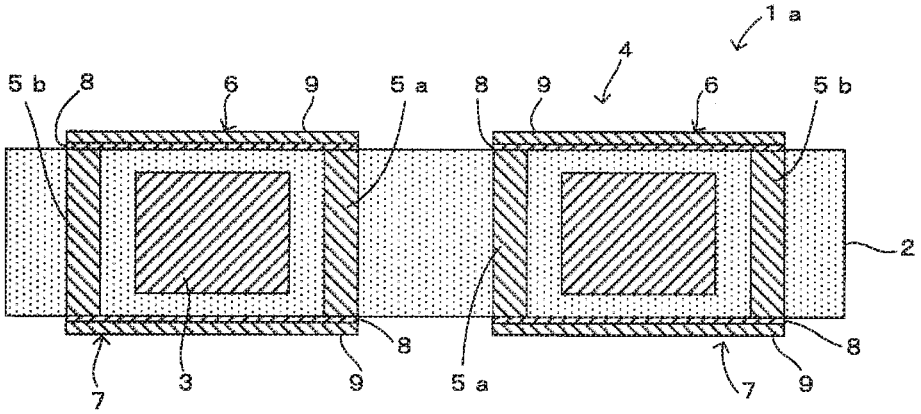
FIG. 1 is a cross-sectional view of a coil component according to a first embodiment of the present disclosure.
Figure 2:
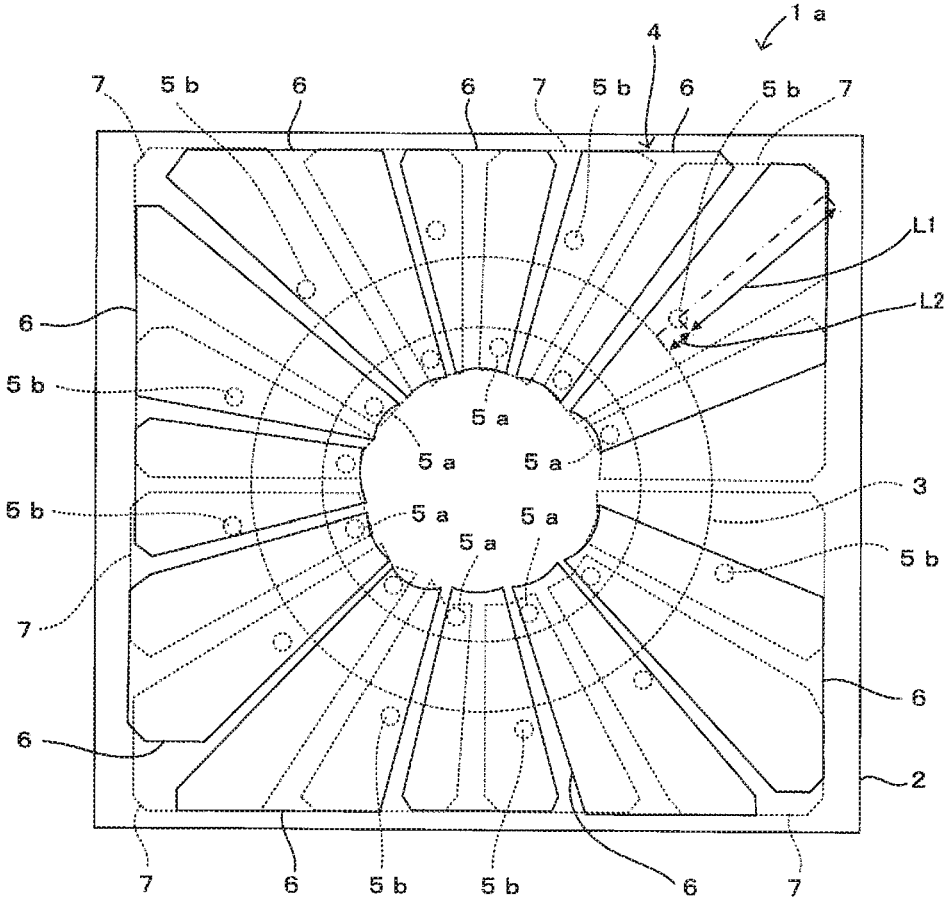
FIG. 2 is a plan view of the coil component illustrated in FIG. 1.
Figure 3A:
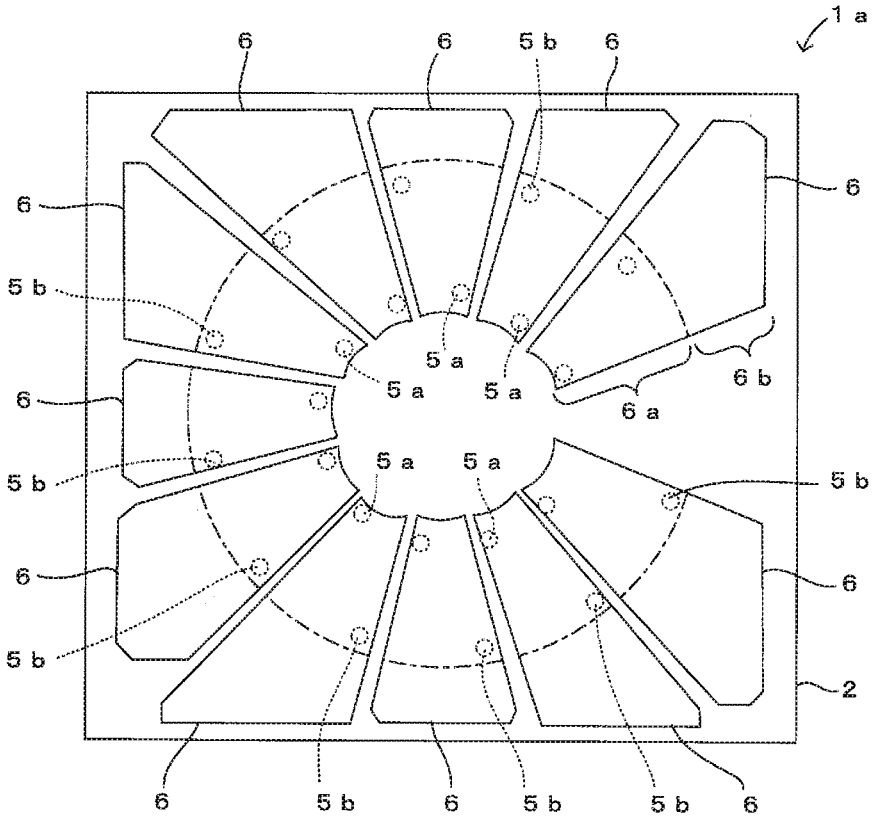
FIGS. 3A and 3B explain wiring patterns illustrated in FIG. 1.
Figure 3B:
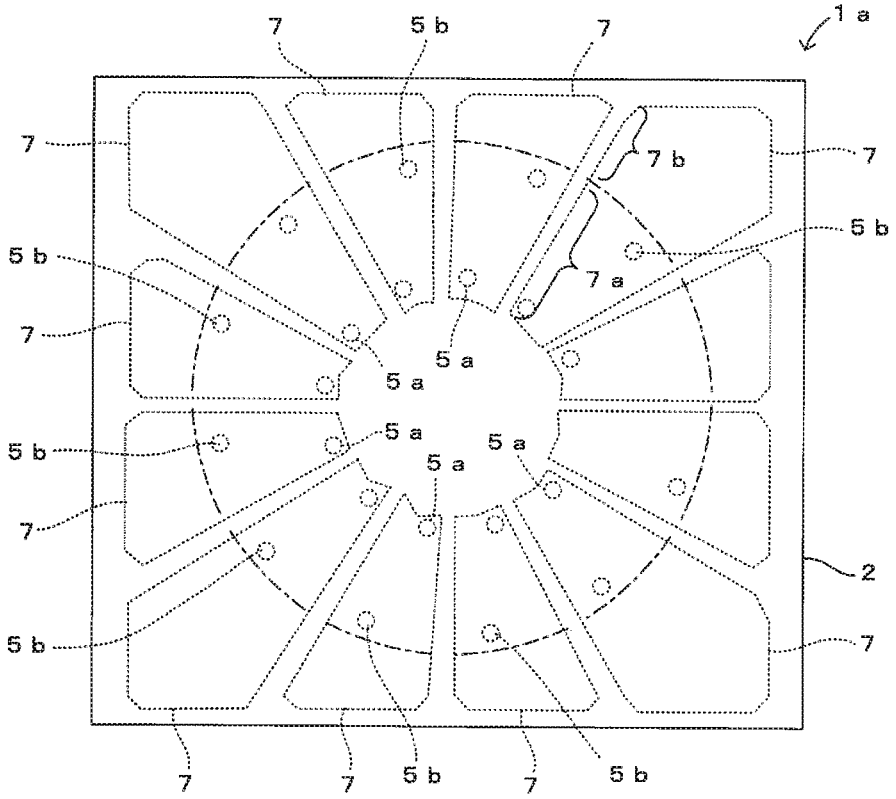

A coil component 1*a* according to a first embodiment of the present disclosure will be described with reference to FIGS. 1 to 3A and 3B. FIG. 1 is a sectional view of the coil component 1*a*, FIG. 2 is a plan view of the coil component 1*a*, and FIGS. 3A and 3B explain upper and lower wiring patterns 6 and 7. FIG. 3A is a plan view of the coil component 1*a* from which a coil core 3 and the lower wiring patterns 7 are removed, and FIG. 3B is a plan view of the coil component 1*a* from which the coil core 3 and the upper wiring patterns 6 are removed.

As illustrated in FIGS. 1 to 3A and 3B, the coil component 1*a* according to this embodiment includes an insulating layer 2 having a coil core 3 embedded therein and a coil electrode 4 wound around the coil core 3, and is mounted in an electronic device, such as a cellular phone, using a high-frequency signal.

For example, the insulating layer 2 is made of resin such as epoxy resin, and has a predetermined thickness to cover the coil core 3 and a plurality of metal pins 5*a* and 5*b* to be described later. In this embodiment, the principal surfaces (an upper surface and a lower surface) of the insulating layer 2 are rectangular.

The coil core 3 is made of a magnetic material adopted in a typical coil core, for example, Mn—Zn ferrite. In this embodiment, the coil core 3 has an annular shape.

The coil electrode 4 is helically wound around the annular coil core 3, and includes a plurality of inner metal pins 5*a* (corresponding to "inner conductors" in the present disclosure) arranged along an inner peripheral surface of the coil core 3, a plurality of outer metal pins 5*b* (corresponding to "outer conductors" in the disclosure) arranged along an outer peripheral surface of the coil core 3 to form a plurality of pairs with the inner metal pins 5*a*, a plurality of upper wiring patterns 6 provided on an upper surface of the insulating layer 2, and a plurality of lower wiring patterns 7 provided on a lower surface of the insulating layer 2.

The lower wiring patterns 7 are arranged in a winding axis direction of the coil electrode 4 (a circumferential direction of the coil core 3) in a state in which one end of each of the lower wiring patterns 7 is disposed on an inner peripheral side of the coil core 3 and the other end thereof is disposed on an outer peripheral side of the coil core 3. Each of the lower wiring patterns 7 connects one end (lower end) of an inner metal pin 5*a* and one end (lower end) of an outer metal pin 5*b* that are paired with each other.

Similarly to the lower wiring patterns 7, the upper wiring patterns 6 are arranged in the winding axis direction of the coil electrode 4 (circumferential direction of the coil core 3) in a state in which one end of each of the upper wiring patterns 6 is disposed on the inner peripheral side of the coil core 3 and the other end thereof is disposed on the outer peripheral side of the coil core 3. Each of the upper wiring patterns 6 connects the other end (upper end) of an outer metal pin 5*b* and the other end (upper end) of an inner metal pin 5*a* adjacent to a predetermined side (in a clockwise direction in the embodiment) of an inner metal pin 5*a* that is paired with the outer metal pin 5*b*.

Each of the upper and lower wiring patterns 6 and 7 has a two-layer structure composed of an underlying electrode 8 formed by screen printing using conductive paste containing metal such as Cu or Ag, and a surface electrode 9 deposited on the underlying electrode 8 by, for example, Cu plating. The upper and lower wiring patterns 6 and 7 may have a single-layer structure. In this case, the upper and lower wiring patterns 6 can be formed by screen printing using conductive paste containing metal such as Cu or Ag, similarly to the underlying electrode 8. Here, the above-described upper wiring patterns 6 correspond to "second wiring patterns" in the present disclosure, and the lower wiring patterns 7 correspond to "first wiring patterns" in the disclosure.

The inner metal pins 5*a* are arranged along the inner peripheral surface of the coil core 3 in a state in which an upper end of each of the inner metal pins 5*a* is exposed from the upper surface of the insulating layer 2 and a lower end thereof is exposed from the lower surface of the insulating layer 2. The outer metal pins 5*b* are arranged along the outer peripheral surface of the coil core 3 in a state in which an upper end of each of the outer metal pins 5*b* is exposed from the upper surface of the insulating layer 2 and a lower end thereof is exposed from the lower surface of the insulating layer 2.

These metal pins 5*a* and 5*b* are made of a metal material generally adopted as a wiring electrode, for example, Cu, Au, Ag, Al, or a Cu-based alloy. In this embodiment, the metal pins 5*a* and 5*b* are shaped like columns that are almost the same in thickness and length. The metal pins 5*a* and 5*b* can be formed by, for example, shearing a wire made of any of these metal materials. While the inner metal pins 5*a* and the outer metal pins 5*b* are columnar in this embodiment, they may be shaped like, for example, a prism. Members corresponding to the inner and outer metal pins 5*a* and 5*b* may be formed by columnar conductors such as via conductors.

The conductive paste that makes the upper and lower wiring patterns 6 and 7 is formed, for example, by mixing a filler of Cu or Ag and an organic solvent. Hence, the specific resistance of the metal pins 5*a* and 5*b* is lower than that of the upper and lower wiring patterns 6 and 7. Therefore, when the current is passed, heat is sometimes generated at connecting portions between the wiring patterns 6 and 7 and the metal pins 5*a* and 5*b*. Particularly in the specification in which a high current is passed through the coil electrode 4, such heat needs to be dissipated to the outside. Hence, in this embodiment, the heat radiation characteristics of the coil component 1*a* are improved to cope with the high-current specification.

Specifically, as illustrated in FIG. 3A, each of the upper wiring patterns 6 is composed of a wiring portion 6*a* that connects an upper end of a predetermined inner metal pin 5*a* and an upper end of a predetermined outer metal pin 5*b* (a region in an inner side portion of a one-dot chain line in the wiring pattern 6) and a heat radiating portion 6*b* extended from the wiring portion 6*a* to an outer peripheral side (outer side portion) of the coil core 3 (a region in an outer side portion of the one-dot chain line in the wiring pattern 6).

Further, as illustrated in FIG. 3B, each of the lower wiring patterns 7 is composed of a wiring portion 7*a* that connects a lower end of a predetermined inner metal pin 5*a* and a lower end of a predetermined outer metal pin 5*b* (a region in an inner side portion of a one-dot chain line in the wiring pattern 7) and a heat radiating portion 7*b* extended from the wiring portion 7*a* to the outer peripheral side (outer side portion) of the coil core 3 (a region in an outer side portion of the one-dot chain line in the wiring pattern 7).

In this embodiment, the sizes of the wiring portions 6*a* and 7*a* are slightly larger than the distance between the inner metal pins 5*a* and the outer metal pins 5*b* for reliable connection of the inner and outer metal pins 5*a* and 5*b* (see FIGS. 3A and 3B). In contrast, the heat radiating portions 6*b* and 7*b* are portions of the wiring patterns 6 and 7 further extended from end portions of the wiring portions 6*a* and 7*a* on the outer peripheral side of the coil core 3 toward an edge of the upper surface of the insulating layer 2.

The heat radiating portions 6*b* and 7*b* will be specifically described. The heat radiating portions 6*b* of the upper wiring patterns 6 and the heat radiating portions 7*b* of the lower wiring patterns 7 are extended from the end portions of the wiring portions 6*a* and 7*a* (end portions close to the outer metal pins 5*b*) to the vicinities of the edges of the upper surface or the lower surface of the insulating layer 2 so that the heat radiating portions 6*b* and 7*b* have a large size (area in a plan view). Further, the widths of the wiring patterns 6 and 7 increase from the inner peripheral side toward the outer peripheral side of the coil core 3 by utilizing the degree of freedom in designing the wiring patterns on the outer peripheral side that is higher than on the inner peripheral side.

As illustrated in FIGS. 2, 3A and 3B, each of the wiring patterns 6 and 7 is formed so that a distance L1 from the outer metal pin 5*b* to the outer peripheral end portion of the heat radiating portion 6*b* or 7*b* (corresponding to "first distance" in the present disclosure) is longer than a distance L2 from the outer metal pin 5*b* to the outer peripheral surface of the coil core 3 (corresponding to "second distance" in the disclosure) in a plan view.

Specifically, as illustrated in FIG. 2, the distance L2 is the shortest distance from the outer metal pin 5*b* to the outer peripheral surface of the coil core 3, and the distance L1 is set at a length of a straight line that connects a point, where a straight line drawn by extending the straight line connecting the short distance toward the outer side portion of the coil core 3 intersects the edge of the heat radiating portion 6*b* or 7*b*, to the outer metal pin 5*b*. In this case, the straight line that connects the outer metal pin 5*b* and the outer peripheral surface of the coil core 3 in the shortest distance is a straight line passing through the center of the outer metal pin 5*b* (hereinafter referred to as a reference straight line) of straight lines perpendicular to a tangent to an outer circumference of the coil core 3. The distance L2 is a direct distance between the intersection point of the reference straight line and the outer circumference of the coil core 3, and the center point of the outer metal pin 5*b*, and the distance L1 is a direct line between the center point of the outer metal pin 5*b* and the point where the reference straight line intersects the edge of the heat radiating portion 6*b* or 7*b*. In this embodiment, the shapes of the heat radiating portions 6*b* and 7*b* are set so that the distance L1 is twice or more than the distance L2. As to setting of the distance L1, for example, the length of the longest straight line, of the straight lines that connect the outer metal pin 5*b* and the edge of the heat radiating portion 6*b* or 7*b*, may be set as the distance L1, and the distance L1 may be set to be longer than the distance L2.

The upper wiring patterns 6 are provided on most of the upper surface of the insulating layer 2 except for gaps of predetermined amounts between adjacent upper wiring patterns 6, and this increases the area of the upper wiring patterns 6. In this case, as illustrated in FIG. 3A, the heat radiating portions 6*b* are extended to follow a contour of the upper surface of the insulating layer 2 (sides of the upper surface of the insulating layer 2 having a rectangular shape). That is, the area of the heat radiating portions 6*b* is maximized by making the heat radiating portions 6*b* conform to the rectangular shape of the upper surface of the insulating layer 2. The lower wiring patterns 7 have a similar structure (see FIG. 3B).

While both the upper wiring patterns 6 and the lower wiring patterns 7 have the heat radiating portions 6*b* and the heat radiating portions 7*b* in this embodiment, either the upper wiring patterns 6 or the lower wiring patterns 7 may have the heat radiating portions. For example, when the coil component 1*a* is mounted so that the lower surface of the insulating layer 2 is opposed to a motherboard, only the lower wiring patterns 7 may have heat radiating portions 7*b*. This enables efficient heat radiation toward the motherboard.

Here, each of the wiring portions 6*a* in the upper wiring patterns 6 corresponds to "second wiring portion" in the present disclosure, and each of the heat radiating portions 6*b* corresponds to "second heat radiating portion" in the disclosure. Also, each of the wiring portions 7*a* in the lower wiring patterns 7 corresponds to "first wiring portion" in the disclosure, and each of the heat radiating portions 7*b* corresponds to "first heat radiating portion" in the disclosure.

In this embodiment, as illustrated in FIG. 2, each of the upper wiring patterns 6 is disposed to overlap with both of two adjacent lower wiring patterns 7 in a plan view, and is connected to the two lower wiring patterns 7 by the outer or inner metal pins 5*b* or 5*a* disposed in the overlapping regions.

(Production Method for Coil Component)

Next, an example of a production method for the coil component 1*a* will be described briefly.

First, metal pins 5*a* and 5*b* are placed on one principal surface of a transfer plate shaped like a flat plate. In this case, upper end faces of the metal pins 5*a* and 5*b* are fixed to the one principal surface of the transfer plate, and the metal pins 5*a* and 5*b* are thereby fixed in a standing state. For example, each of the metal pins 5*a* and 5*b* can be formed by shearing a metal wire (for example, Cu, Au, Ag, Al or a Cu-based alloy) having a circular cross section.

Next, a resin layer is formed on one principal surface of a resin sheet (shaped like a flat plate) provided with a release layer. In this case, the resin sheet, the release layer, and the resin layer are placed in this order, and the resin layer is formed in an uncured state.

Next, the transfer plate is inverted and mounted on the resin sheet so that the lower end faces of the metal pins 5*a* and 5*b* are in contact with the resin layer, and the resin of the resin layer is cured.

Next, after the transfer plate is peeled off, a coil core 3 is placed at a predetermined position on the resin sheet, and an insulating layer 2 is formed on the resin sheet by sealing the metal pins 5*a* and 5*b* and the coil core 3 with, for example, epoxy resin.

Next, the resin sheet provided with the release layer is peeled off, and front and back surfaces of the insulating layer 2 are polished or ground. Thus, the upper end faces of the metal pins 5*a* and 5*b* are exposed from an upper surface of the insulating layer 2, and the lower end faces of the metal pins 5*a* and 5*b* are exposed from the lower surface of the insulating layer 2.

Finally, upper wiring patterns 6 are formed on the upper surface of the insulating layer 2, and lower wiring patterns 7 are formed on the lower surface of the insulating layer 2, so that a coil component 1*a* is completed. For example, the upper and lower wiring patterns 6 and 7 can be formed by screen printing using conductive paste containing metal such as Cu. The upper and lower wiring patterns 6 and 7 may be provided with a two-layer structure by subjecting the wiring patterns made of the conductive paste to Cu plating. As another example of a forming method for the upper and lower wiring patterns 6 and 7, one principal surface of a platelike member to which Cu foil is attached is processed in a predetermined pattern shape (shape of the upper or lower wiring patterns 6 and 7) by etching. This platelike member is prepared for the upper wiring patterns 6 and the lower wiring patterns 7 individually. In this case, the upper and lower wiring patterns 6 and 7 can be joined to the upper end faces or the lower end faces of the metal pins 5*a* and 5*b* by ultrasonic bonding using the platelike member.

Therefore, according to the above-described embodiment, the upper and lower wiring patterns 6 and 7 respectively have the heat radiating portions 6*b* and 7*b* extended from the wiring portions 6*a* and 7*a*. Hence, the upper and lower wiring patterns 6 and 7 have the heat radiating function using the heat radiating portions 6*b* and 7*b* in addition to the function of connecting a lower end of a predetermined inner metal pin 5*a* and a lower end of a predetermined outer metal pin 5*b*. This can improve the heat radiation characteristics of the coil component 1*a*. Further, since the heat radiation characteristics of the coil component 1*a* are improved, the coil electrode 4 can cope with a high current.

The heating radiating portions 6*b* and 7*b* are extended from the end portions of the wiring portions 6*a* and 7*a* toward the outer peripheral side of the coil core 3 so as to reach the vicinity of the edge of the upper surface or the lower surface of the insulating layer 2. When the coil core 3 is annular, the degree of freedom in designing, for example, the wiring patterns is higher in the outer side portion of the coil core 3 than in the inner side portion. Accordingly, the region where the heat radiating portions 6*b* and 7*b* are formed can be easily widened by extending the heat radiating portions 6*b* and 7*b* toward the outer peripheral side of the coil core 3. Further, since the region where the heat radiating portions 6*b* and 7*b* are formed can be widened by forming the heat radiating portions 6*b* and 7*b* to the vicinity of the edge of the upper surface or the lower surface of the insulating layer 2, the heat radiation characteristics of the coil component 1*a* can be improved further.

In the wiring patterns 6 and 7, the sizes of the heat radiating portions 6*b* and 7*b* are set so that the distance L1 from the outer metal pin 5*b* to the heat radiating portion 6*b* or 7*b* is longer than the distance L2 from the outer metal pin 5*b* to the outer peripheral surface of the coil core 3. Hence, the heat radiation characteristics of the coil component 1*a* can be improved reliably.

(Modification of Wiring Patterns)

Figure 4:
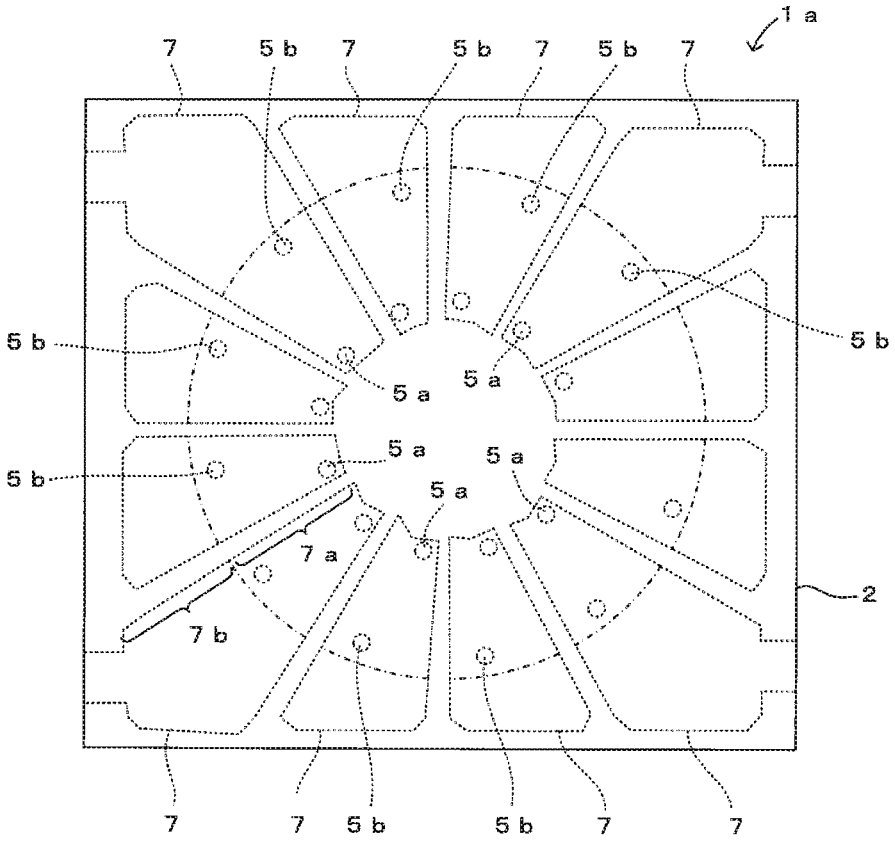
FIG. 4 illustrates a modification of the wiring patterns of FIG. 1.

Next, a modification of the wiring patterns 6 and 7 illustrated in FIGS. 3A and 3B will be described with reference to FIG. 4. FIG. 4 illustrates the modification of the wiring patterns 6 and 7, and corresponds to FIG. 3B.

While the heat radiating portion 7*b* of each lower wiring pattern 7 is extended to the vicinity of the edge of the lower surface of the insulating layer 2 in the above-described embodiment, for example, as illustrated in FIG. 4, the heat radiating portion 7*b* may be extended from an end portion of the wiring portion 7*a* (end portion close to the outer metal pin 5*b*) and reach the edge of the lower surface of the insulating layer 2. In this case, four lower wiring patterns 7 disposed near four corner portions of the lower surface of the rectangular insulating layer 2 are provided so that their heat radiating portions 7*b* reach the edges of the lower surface of the insulating layer 2.

Heat radiating portions 7*b* of lower wiring patterns 7 in portions other than the vicinities of the four corner portions may also reach the edges of the lower surface of the insulating layer 2. Also, not only the lower wiring patterns 7 but also the upper wiring patterns 6 may be similarly provided so that their heat radiating portions 6*b* reach the edges of the upper surface of the insulating layer 2. According to this structure, since the sizes of the heat radiating portions 6*b* and 7*b* can be further increased, the heat radiation characteristics of the coil component 1*a* can be improved further.

Second Embodiment

Figure 5:
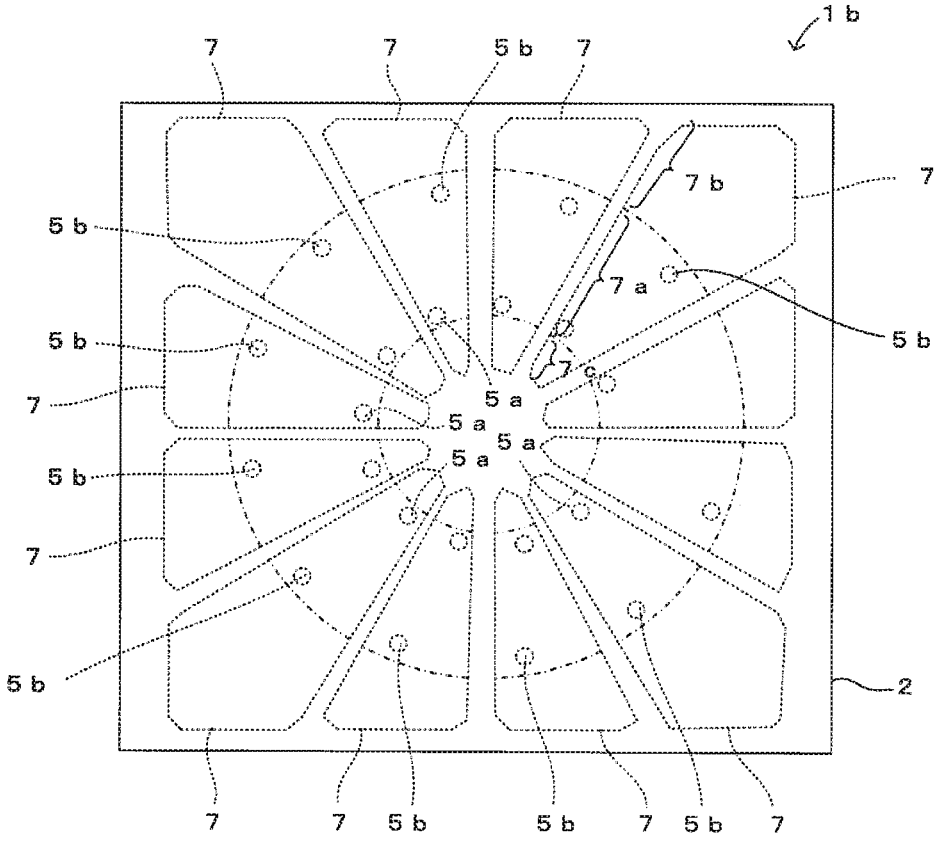
FIG. 5 is a plan view of a coil component according to a second embodiment of the present disclosure.

A coil component 1*b* according to a second embodiment of the present disclosure will be described with reference to FIG. 5. FIG. 5 is a plan view of the coil component 1*b* from which a coil core 3 and upper wiring patterns 6 are removed, and corresponds to FIG. 3B.

The coil component 1*b* of this embodiment is different from the coil component 1*a* of the first embodiment described with reference to FIGS. 1 to 3A and 3B in that each lower wiring pattern 7 further includes a heat radiating portion 7*c* (corresponding to "first heat radiating portion" in the present disclosure) extended from an end portion of a wiring portion 7*a* (end portion close to an inner metal pin 5*a*) toward an inner peripheral side of the coil core 3 in addition to a heat radiating portion 7*b* extended toward an outer peripheral side of the wiring portion 7*a*, as illustrated in FIG. 5. Since other structures are the same as those of the coil component 1*a* of the first embodiment, they are denoted by the same reference numerals, and descriptions thereof are skipped.

In this case, similarly to each heat radiating portion 7*b* on the outer peripheral side, each heat radiating portion 7*c* on the inner peripheral side is provided so that the distance from an inner metal pin 5*a* to an inner peripheral end portion of the heat radiating portion 7*c* is longer than (twice or more in this embodiment) the distance from the inner metal pin 5*a* to an inner peripheral surface of the coil core 3 in a plan view.

According to this structure, since the heat generated in a coil electrode 4 when current is passed therethrough can be dissipated not only from the heat radiating portion 7*b* on the outer peripheral side of the coil core 3 but also from the heat radiating portion 7*c* on the inner peripheral side, the heat radiation characteristics of the coil component 1*b* can be improved further. Similarly, upper wiring patterns 6 may have heat radiating portions on the inner peripheral side of the coil core 3.

Third Embodiment

Figure 6:
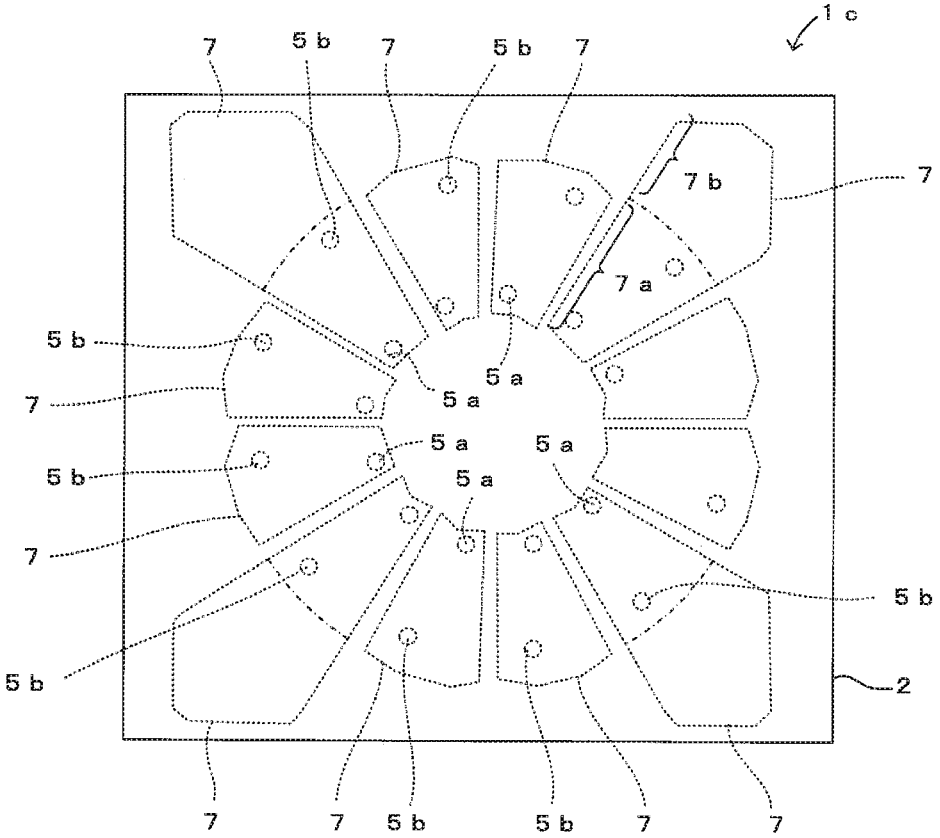
FIG. 6 is a plan view of a coil component according to a third embodiment of the present disclosure.

A coil component 1*c* according to a third embodiment of the present disclosure will be described with reference to FIG. 6. FIG. 6 is a plan view of the coil component 1*c* from which a coil core 3 and upper wiring patterns 6 are removed, and corresponds to FIG. 3B.

The coil component 1*c* of this embodiment is different from the coil component 1*a* of the first embodiment described with reference to FIGS. 1 to 3A and 3B in that only lower wiring patterns 7 disposed near four corners of a lower surface of an insulating layer 2, of a plurality of lower wiring patterns 7, have heat radiating portions 7*b*, as illustrated in FIG. 6. Since other structures are the same as those of the coil component 1*a* of the first embodiment, they are denoted by the same reference numerals, and descriptions thereof are skipped.

In this case, in each of four lower wiring patterns 7 closest to four corners of the lower surface of the insulating layer 2, a heat radiating portion 7*b* is extended from an end portion of a wiring portion 7*a* (end portion close to an outer metal pin 5*b*) to the vicinity of an edge of the lower surface of the insulating layer 2. Each of the other lower wiring patterns 7 is composed of only a wiring portion 7*a*.

When the lower surface of the insulating layer 2 is rectangular, wiring patterns or the like are not provided in the four corner portions in most cases, and the degree of design flexibility is relatively high in these portions. Hence, the heat radiating portion 7*b* can be easily made large. When the heat radiating portions 7*b* are not provided in the lower wiring patterns 7 disposed in the spaces other than the four corner portions, the spaces can be used for other applications, for example, other wiring patterns can be provided in the spaces. For this reason, when only the lower wiring patterns 7 disposed near the four corner portions have the heat radiating portions 7*b*, the heat radiation characteristics of the coil component 1*c* can be efficiently improved by utilizing the vacant spaces.

(Modification of Wiring Patterns)

Figure 7:
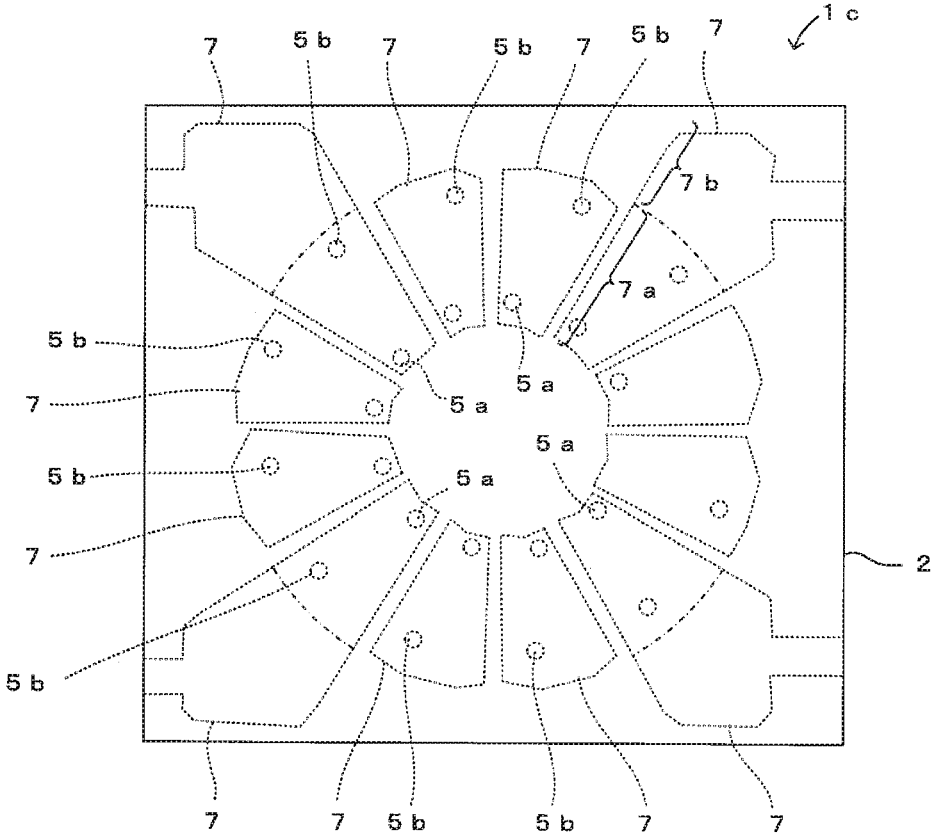
FIG. 7 illustrates a modification of wiring patterns illustrated in FIG. 6.

Next, a modification of the wiring patterns 6 and 7 illustrated in FIG. 6 will be described with reference to FIG. 7. FIG. 7 illustrates the modification of the wiring patterns 6 and 7, and corresponds to FIG. 6.

While the heat radiating portions 7*b* in the lower wiring patterns 7 are extended to the vicinities of the edges of the four corners of the lower surface of the insulating layer 2 in the above-described embodiment, for example, as illustrated in FIG. 7, the heat radiating portions 7*b* may be provided to extend from end portions of the wiring portions 7*a* (end portions close to outer metal pins 5*b*) to edges of the lower surface of the insulating layer 2 (edges at four corners). According to this structure, the size of the heat radiating portions 7*b* can be further increased. Moreover, since the heat radiating portions 7*b* reach the edges of the insulating layer 2 and the heat radiating portions 7*b* are exposed from the side surfaces of the insulating layer 2, the heat radiation characteristics of the coil component 1*c* can be improved further.

Not only the lower wiring patterns 7, but also the upper wiring patterns 6 may be similarly provided so that heat radiating portions 6*b* are provided in upper wiring patterns 6 disposed near four corners of an upper surface of the insulating layer 2, and these heat radiating portions 6*b* may be provided to reach the edges of the upper surface of the insulating layer 2 (edges at the four corners).

Fourth Embodiment

Figure 8:
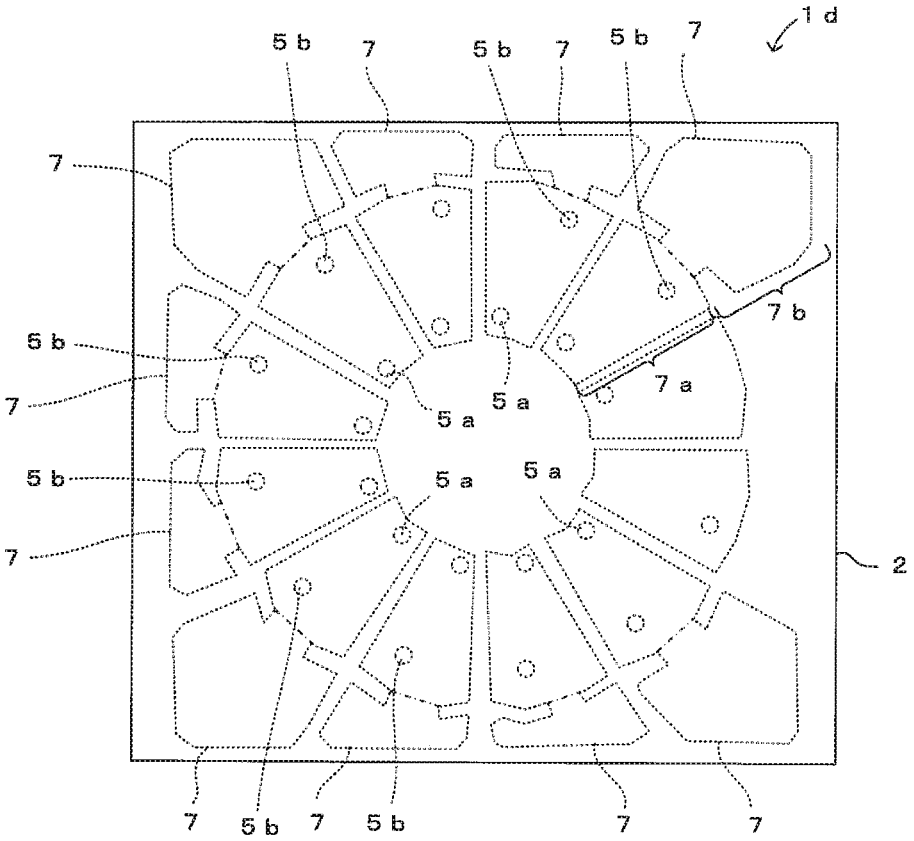
FIG. 8 is a plan view of a coil component according to a fourth embodiment of the present disclosure.
Figure 9:
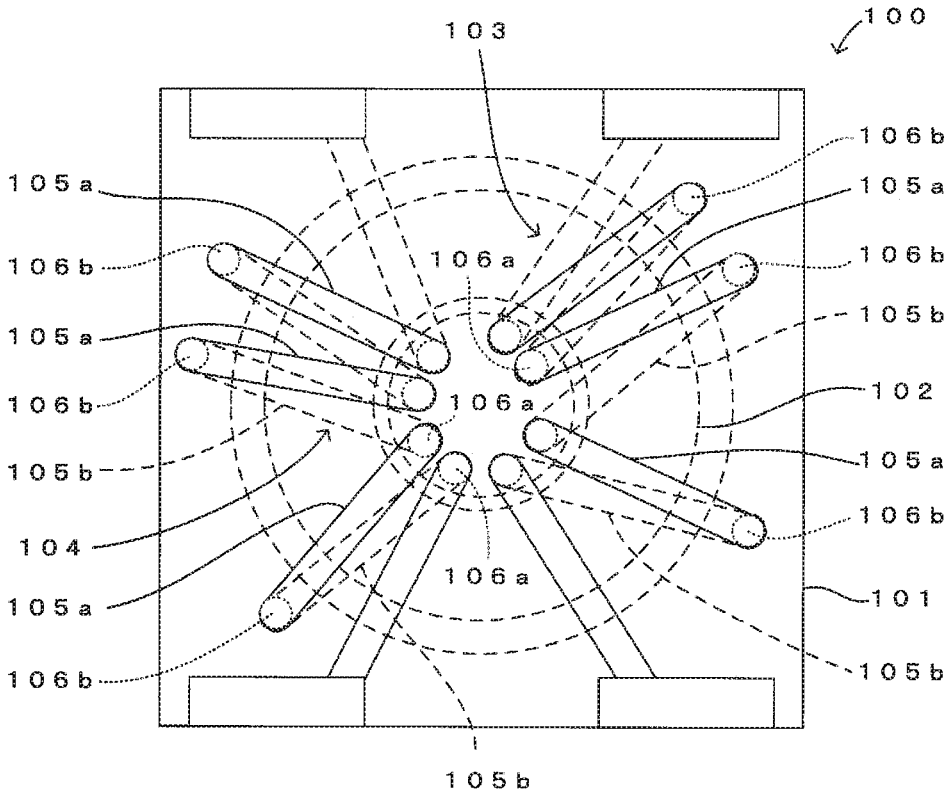
FIG. 9 is a plan view of a conventional coil component.

A coil component 1*d* according to a fourth embodiment of the present disclosure will be described with reference to FIG. 8. FIG. 8 is a plan view of the coil component 1*d* from which a coil core 3 and upper wiring patterns 6 are removed, and corresponds to FIG. 3B.

The coil component 1*d* of this embodiment is different from the coil component 1*a* of the first embodiment described with reference to FIGS. 1 to 3A and 3B in the shape of heat radiating portions 7*b* provided in lower wiring patterns 7, as illustrated in FIG. 8. Since other structures are the same as those of the coil component 1*a* of the first embodiment, they are denoted by the same reference numerals, and descriptions thereof are skipped.

In this case, each of the heat radiating portions 7*b* in the lower wiring patterns 7 is narrow at a portion connected to a wiring portion 7*a*. Even when the heat radiating portions 7*b* have such a shape, effects similar to those of the coil component 1*a* of the first embodiment can be obtained. Heat radiating portions 6*b* of the upper wiring patterns 6 may have a shape similar to that of the heat radiating portions 7*b* of the lower wiring patterns 7.

The present disclosure is not limited to the above-described embodiments, and various modifications other than the above can be made without departing from the scope of the disclosure. For example, the insulating layer 2 may be made of a ceramic material.

The structures of the embodiments may be combined. For example, in addition to the structure of the coil component 1*c* of the third embodiment, the heat radiating portions 7*c* may also be provided on the inner peripheral side of the coil core 3 like the structure of the second embodiment.

Protective films may be provided on the upper and lower surfaces of the insulating layer 2 to protect the upper wiring patterns 6 and the lower wiring patterns 7. In this case, examples of the material of the protective films include epoxy resin and polyimide resin.

The present disclosure can be widely applied to various coil components each including an insulating layer having an annular coil core embedded therein and a coil electrode wound around the coil core.

1*a* to 1*d* coil component
2 insulating layer
3 coil core
4 coil electrode
5*a* inner metal pin (inner conductor)
5*b* outer metal pin (outer conductor)
6 upper wiring pattern (second wiring pattern)
6*a* wiring portion (second wiring portion)
6*b* heat radiating portion (second heat radiating portion)
7 lower wiring pattern (first wiring pattern)
7*a* wiring portion (first wiring portion)
7*b*, 7*c* heat radiating portion (first heat radiating portion)
L1 distance (first distance)
L2 distance (second distance)

The invention claimed is:

1. A coil component comprising:

an insulating layer having an annular coil core embedded therein; and a coil electrode wound around the coil core, wherein the coil electrode includes:

a plurality of inner conductors arranged along an inner peripheral surface of the coil core while being exposed at one end from one principal surface of the insulating layer and being exposed at another end from another principal surface of the insulating layer, a plurality of outer conductors arranged along an outer peripheral surface of the coil core to form a plurality of pairs with the inner conductors while being exposed at one end from the one principal surface of the insulating layer and being exposed at the other end from the other principal surface of the insulating layer, a plurality of first wiring patterns provided on the one principal surface of the insulating layer to connect the one end of each of the inner conductors to the one end of each of the outer conductors forming a pair with each of the inner conductors, and a plurality of second wiring patterns provided on the other principal surface of the insulating layer to connect the other end of each of the outer conductors to the other end of each of the inner conductors adjacent to each of the inner conductors forming the pair with each of the outer conductors, wherein each of the first wiring patterns has a first wiring portion connecting the one end of each of the outer conductors to the one end of each of the inner conductors, and at least one of the first wiring patterns further has a first heat radiating portion extended from an end portion of the first wiring portion starting from the one end of each of the outer conductors and away from the coil core, and wherein, in a plan view, the first wiring pattern having the first heat radiating portion has a first distance from each of the inner conductors or each of the outer conductors to an end portion on a side of the first heat radiating portion, and has a second distance from each of the inner conductors or each of the outer conductors to the coil core, and wherein the first distance is longer than a second distance.

2. The coil component according to claim 1, wherein the first distance is twice or more than the second distance.

3. The coil component according to claim 1, wherein the first heat radiating portion is extended from the first wiring portion toward the outer peripheral side of the coil core.

4. The coil component according to claim 3, wherein the first heat radiating portion is extended to follow a contour of the one principal surface.

5. The coil component according to claim 3, wherein the first heat radiating portion is provided to reach an edge of the one principal surface of the insulating layer.

6. The coil component according to claim 1, wherein the one principal surface of the insulating layer has a rectangular shape, and wherein the first heat radiating portion is provided only in some of the first wiring patterns disposed near four corner portions of the one principal surface of the insulating layer.

7. The coil component according to claim 1, wherein the first heat radiating portion is provided in all of the first wiring patterns.

8. The coil component according to claim 1, wherein each of the second wiring patterns has a second wiring portion connecting the other end of the outer conductor to the other end of the inner conductor, and at least one of the second wiring patterns further has a second heat radiating portion extended from the second wiring portion to at least one of the inner peripheral side and the outer peripheral side of the coil core.

9. The coil component according to claim 2, wherein the first heat radiating portion is extended from the first wiring portion toward the outer peripheral side of the coil core.

10. The coil component according to claim 2, wherein the one principal surface of the insulating layer has a rectangular shape, and wherein the first heat radiating portion is provided only in some of the first wiring patterns disposed near four corner portions of the one principal surface of the insulating layer.

11. The coil component according to claim 3, wherein the one principal surface of the insulating layer has a rectangular shape, and wherein the first heat radiating portion is provided only in some of the first wiring patterns disposed near four corner portions of the one principal surface of the insulating layer.

12. The coil component according to claim 4, wherein the one principal surface of the insulating layer has a rectangular shape, and wherein the first heat radiating portion is provided only in some of the first wiring patterns disposed near four corner portions of the one principal surface of the insulating layer.

13. The coil component according to claim 5, wherein the one principal surface of the insulating layer has a rectangular shape, and wherein the first heat radiating portion is provided only in some of the first wiring patterns disposed near four corner portions of the one principal surface of the insulating layer.

14. The coil component according to claim 2, wherein the first heat radiating portion is provided in all of the first wiring patterns.

15. The coil component according to claim 3, wherein the first heat radiating portion is provided in all of the first wiring patterns.

16. The coil component according to claim 4, wherein the first heat radiating portion is provided in all of the first wiring patterns.

* * * * *